US006898890B2

(12) United States Patent
Gaber

(10) Patent No.: US 6,898,890 B2
(45) Date of Patent: May 31, 2005

(54) NIGHT-VISION OPTICAL DEVICE HAVING CONTROLLED LIFE EXPECTANCY

(75) Inventor: Leonid Gaber, San Leandro, CA (US)

(73) Assignee: American Technologies Network Corp., South San Francisco, CA (US)

( * ) Notice: Subject to any disclaimer, the term of this patent is extended or adjusted under 35 U.S.C. 154(b) by 0 days.

(21) Appl. No.: 10/400,259

(22) Filed: Mar. 28, 2003

(65) Prior Publication Data

US 2004/0200117 A1 Oct. 14, 2004

(51) Int. Cl.[7] ..... F41G 1/32

(52) U.S. Cl. ..... 42/123; 42/1.01; 42/84; 42/131; 42/132; 42/146; 250/214 LA; 250/483.1; 313/524; 313/603; 327/103; 327/231; 327/514; 327/529; 359/350

(58) Field of Search ..... 42/1.01, 84, 123, 42/131, 132, 146; 89/1.1; 250/214 LA, 483.1, 484.2; 359/350, 353, 399, 400, 402, 407; 313/524, 603, 514; 327/103, 231, 514, 529

(56) References Cited

U.S. PATENT DOCUMENTS 3,793,571 A * 2/1974 Janssen ..... 313/368
3,872,349 A * 3/1975 Spero et al. ..... 315/39
4,468,101 A * 8/1984 Ellis ..... 313/524
4,533,980 A * 8/1985 Hayes ..... 362/110
4,777,352 A * 10/1988 Moore ..... 235/404
5,023,511 A * 6/1991 Phillips ..... 313/524
5,477,106 A * 12/1995 Lednum et al. ..... 313/589
5,566,486 A * 10/1996 Brinkley ..... 42/1.02
5,665,959 A * 9/1997 Fossum et al. ..... 250/208.1
5,729,010 A * 3/1998 Pinkus et al. ..... 250/214 VT
5,786,932 A * 7/1998 Pniel ..... 359/409
5,837,918 A * 11/1998 Sepp ..... 89/1.11
5,842,300 A * 12/1998 Cheshelski et al. ..... 42/116
5,918,304 A 6/1999 Gartz ..... 89/1.1
5,933,224 A * 8/1999 Hines et al. ..... 356/4.01
5,954,507 A * 9/1999 Rod et al. ..... 434/19
6,094,304 A * 7/2000 Wallace et al. ..... 359/425
6,150,650 A 11/2000 Bowen et al. ..... 250/214
6,208,461 B1 * 3/2001 Gaber ..... 359/399
6,225,742 B1 * 5/2001 Iida et al. ..... 315/56
6,320,180 B1 * 11/2001 Estrera et al. ..... 250/214 V
6,327,806 B1 * 12/2001 Paige ..... 42/113
6,483,258 B2 * 11/2002 Vo ..... 315/291
6,526,686 B1 * 3/2003 Poff et al. ..... 42/84
6,564,687 B2 * 5/2003 Poole ..... 89/1.11

* cited by examiner

*Primary Examiner*—Michael J. Carone
*Assistant Examiner*—John Richardson

(57) ABSTRACT

A night-vision optical device of the invention with controlled life expectancy contains a time measuring device built into the housing of the aforementioned device for measuring the accumulated time of active work of the device. In application to a night scope for a firearm, the device also contains a sensor, which is interlocked with activation of the scope and reacts on the shots produced from the firearm in general and separately on those shots produced during active work of the night-vision optics at nighttime. The aforementioned shots of both types are counted and stored in separate memory units. The night-time shots affects the life expectancy of the night-vision optics because of muzzle flashes which cause such devices as an image intensifier to work with an increased light load. The information obtained from the time measuring device and the shot counter makes it possible to timely receive a warning signal about the fact that the night optics or the entire firearm must be replaced.

20 Claims, 4 Drawing Sheets

NIGHT-VISION OPTICAL DEVICE HAVING CONTROLLED LIFE EXPECTANCY

FIELD OF THE INVENTION

The present invention relates to night vision optical devices, in particular to night-vision optical devices with controlled life expectancy. More specifically, the invention relates to night vision optical aiming devices for firearms, or the like.

BACKGROUND OF THE INVENTION

It is known that cathodes, phosphorescence screens, and luminescent devices degrade during work in vacuum, and their life expectancy depends on the accumulated time of active work, as well as on the number of ON and OFF switchings. With the lapse of the accumulated operation time performance characteristics of the aforementioned devices are worsened, and therefore these devices can be used to a predetermined limit.

For the night vision optical devices, such as night vision riflescopes with image intensifiers, in addition to the accumulated time of active work, the life expectation of the scope also depends on the number of so-called muzzle flashes, which occur during nighttime shooting. In fact, the accumulated number of flashes of bright light is one important criterion that determines the service life of the sight with the night-vision optics.

Attempts have been made to extend the service life, e.g., of night vision devices with image intensifying tubes by utilizing an adjustable variable gain. Thus U.S. Pat. No. 6,150,650 issued in 2000 to J. Bowen, et al. describes a night vision device which utilizes an image intensifier tube, wherein the image intensifier tube has a given life expectancy, the image intensifier tube being subjected to factory calibration for providing an optimum output during operation, wherein the calibration undesirably differs from tube to tube and is adjustable by variable control means coupled to the tube, whereby when one tube is substituted for another the difference in calibration causes non-optimum performance. The method includes the steps of: determining minimum and maximum gain limits associated with the optimum output of the night vision device; factory calibrating gain limiting means according to the determined minimum and maximum gain limits, wherein the gain limiting means are associated with the image intensifier tube and for limiting the variable control means; and, tethering the gain limiting means to the image intensifier tube.

In other words, since the gain of an image intensifier tubes supplied by the manufacturers and used in firearm aiming device changes, it is proposed to adjust the gain with reference to the changes in order to maintain the gain at a relatively constant level. This is because some of the factory-supplied image intensifier tubes are overadjusted to an excessive gain or power and will have a shortened life time, while others are underadjusted and though will have a longer service life, will not work with a required efficiency. This means that variations in the life expectancy of the image intensifiers may occur in a very broad range. The optimization proposed in U.S. Pat. No. 6,150,650 narrows the above range. It Is understood, however, that in order to efficiently control the workability of the night vision optics, it is important to known the expected service life of the night vision optics in order to replace it in time. This is especially important for night-vision optics used in night-vision sights of a firearm, where unexpected failure of the sight under combat conditions is absolutely Intolerable.

It is understood that in reality the life expectancy of a night vision optics may vary in a very wide range depending on specific conditions of practical application. For example, when a night vision optics is used in an optical aiming device of a firearm that contains an image intensifier and when it is used in intensive battle conditions with frequent muzzle flashes which shorten the lifetime of the image intensifier because of a high light load, the life time of such an aiming device will be shorter than in the case of a sniper work who keeps the night vision optics in the ON condition over a long time but without flashes and under a low light load. In other words, the life expectation of la night vision device with cathodes, fluorescent screens, and similar items operating in vacuum will depends, among other things, on two main factors: the accumulated time of actual operation (SWITCHED-ON condition) of the night vision optics and the number of muzzle flashes when the optics operates with a very high light load.

As far as a firearm is concerned, It is understood that with the lapse of time any weapon loses Its initial performance characteristics. Although the weapon is subject to damages caused by natural causes such as corrosion, loosening of fasteners, creeping and ageing deformation of the materials, or the like, these changes are normally revealed after such long period of time when the weapon becomes practically obsolete and is replaced by several new generations. On the other hand, when the weapon is frequently used for its direct purpose, i.e., for shooting, the process of weapon degradation is accelerated with a factor of several thousand. This is because shooting is accompanied by friction and wear, e.g., on the inner surface of the weapon barrel. Therefore, attempts have been made to limits the service life of a weapon by counting the number of shots. For example, U.S. Pat. No. 5,918,304 issued in 1999 to Karl Gartz describes an apparatus for monitoring the firing stress of a weapon barrel. It is stated that the barrels of particularly large-caliber weapons have to be replaced for safety reasons after firing a predetermined number of rounds. For this purpose a "barrel log" must be maintained in which the number of rounds fired from the barrel and the respective charge type (if different charges are used for the barrel) have to be entered. The invention is essentially based on the principle to measure, with a suitable sensor, the actual body sound signals (body oscillations) obtained upon the firing of the weapon and to compare the signals in an electronic evaluating apparatus with reference signals which characterize the different charges and which are stored in a memory. The charge value which is associated with the actual signal value and which is obtained from such a comparison is subsequently stored in a non-volatile memory of the evaluating apparatus and is added to an already stored charge value. The same applies to the number of shots measured by the sensor. The accumulated firing stress may be automatically and very accurately determined and may be at any time retrieved from the memory (electronic barrel log). Further, the apparatus may serve as a counter of fired rounds. Also, the apparatus may be utilized for determining the barrel condition because a change of the barrel condition leads to a characteristic change of the frequency spectrum of the measuring signal.

For the modern weapon, which is equipped with various optical and electronic devices, this problem is especially aggravated, but the weapons which are most of all sensitive to impacts resulting from the shots and recoil forces are those which are equipped with electro-vacuum devices such as image intensifiers, some distance ranges, night-vision optics, etc. In other words, for firearms used in combination with night-vision optics or similar devices that utilize vacuum electronic units with cathodes, phosphorescence screens or the like, the life expectation of the firearm is determined not only by the number of shots, wear, or mechanical damage but also by the service life of the aforementioned optical devices which is normally limited to several thousand hours of active work and, as has been mentioned above, to a great extent depends on the number of muzzle flashes acting-on cathodes, phosphorescence screens, luminescent devices, or similar elements of vacuum night vision optics.

However, none of the existing prior-art devices known to the applicant are used for controlling or diagnosing the life expectation of the night vision instruments with reference to three aforementioned factors (number of shots, active time of operation of the night vision optics, and number of muzzle flashes during the use of the night vision optics) and their relationship.

OBJECTS AND SUMMARY OF THE INVENTION

It is an object of the present invention to provide a night-vision optical device having a controlled life expectancy. It is another object to provide a night vision optical device of the aforementioned type, which accumulates information relating to the time of active work of the device. It is another object to provide a night-vision optical aiming device for a firearm, which accumulates information relating to the total number of shots produced from the firearm. It is another object to provide a night vision optical aiming device of the aforementioned type, which accumulates information relating to the number of shots counted in parallel with measuring the time of active work of the night-vision optical aiming device. It is another object to provide a night-vision optical aiming device of aforementioned type which has a shot counter in combination with a unit that generates a signal indicating that the night-vision optics or the entire firearm has to be replaced. It is It is another object to provide a night vision optical aiming device of the aforementioned type, in, which the time and shot number information is stored and can be retrieved and displayed on the optical device or in a remote location.

A night-vision optical device of the invention with controlled life expectancy contains a time measuring device built into the housing of the aforementioned device for measuring the accumulated time of active work of the device. In application to a night scope for a firearm, the device also contains a sensor, which is interlocked with activation of the scope and reacts on the shots produced from the firearm in general and separately on those shots produced during active work of the night-vision optics at nighttime. The aforementioned shots of both types are counted and stored in separate memory units. The night-time shots affects the life expectancy of the night-vision optics because of muzzle flashes which cause such devices as an Image intensifier to work with an increased light load. The information obtained from the time measuring device and the shot counter makes it possible to timely receive a warning signal about the fact that the night optics or the entire firearm must be replaced.

DETAILED DESCRIPTION OF THE INVENTION

One practical embodiment of the invention will be described below with reference to a night-vision optical aiming device. It is understood that this can be a night-vision optical device of any type and that the application to a riflescope described below should be considered only as an example.

Figure 1:
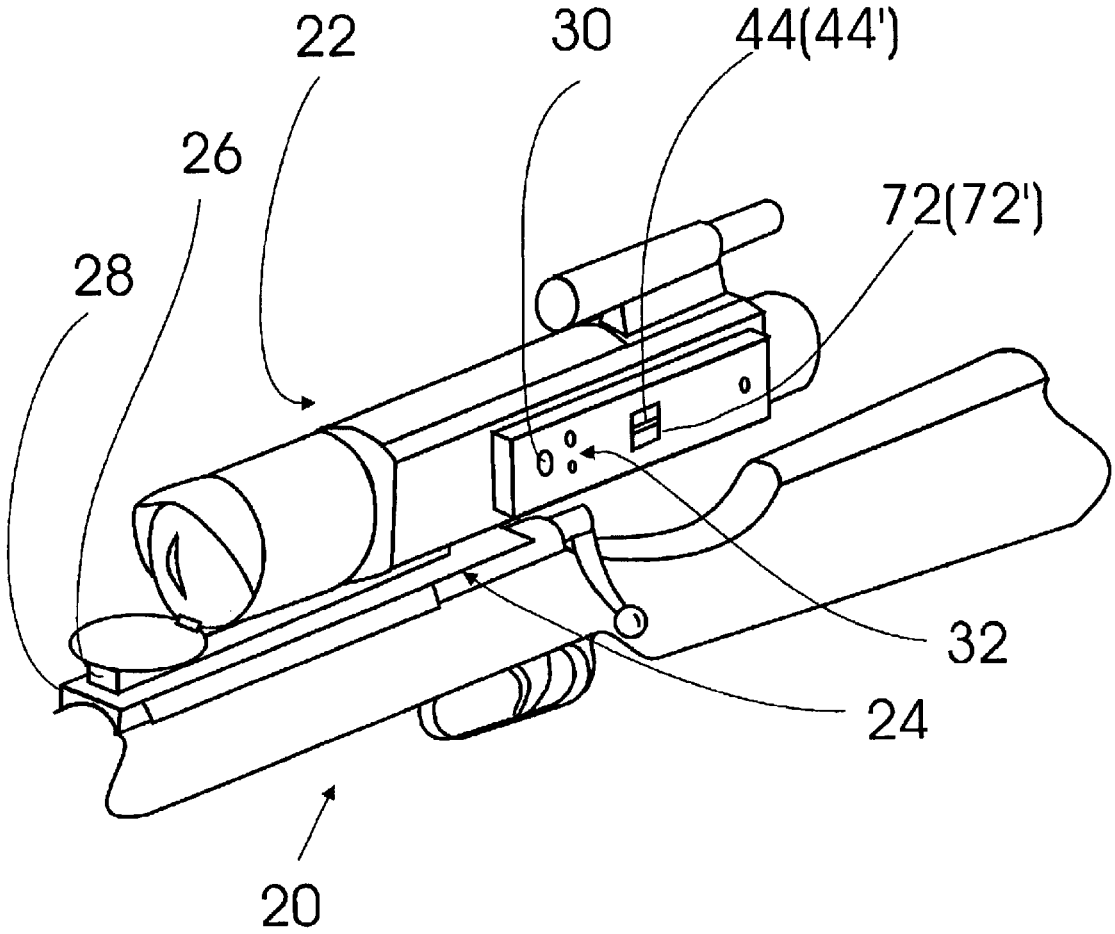
FIG. 1 is a three-dimensional view of the optical sight of the invention installed on a rifle.

FIG. 1 is a general three-dimensional view of a firearm 20 equipped with a night-vision aiming device 22 of the invention attached in a known manner to the firearm 20, e.g., with a one-piece plate 24 of the firearm and the mounting bracket 26 of the night-vision aiming device 22 which are connected, e.g., via a dovetail arrangement 28. It is understood that the type of connection is beyond the scope of the present invention. Such a device may be represented, e.g., by a night-vision sight of ARIES MK-6600 type produced by American Technology Network Corporation, So. San Francisco, Calif. USA.

Reference numeral 30 designates the ON/OFF button of the night-vision aiming device. Reference numeral 32 designates a socket for a connector (not shown) that can connect the measuring units (described in detail below) of the night-vision aiming device 22 with a remote data reading system (not shown in FIG. 1).

Figure 2:
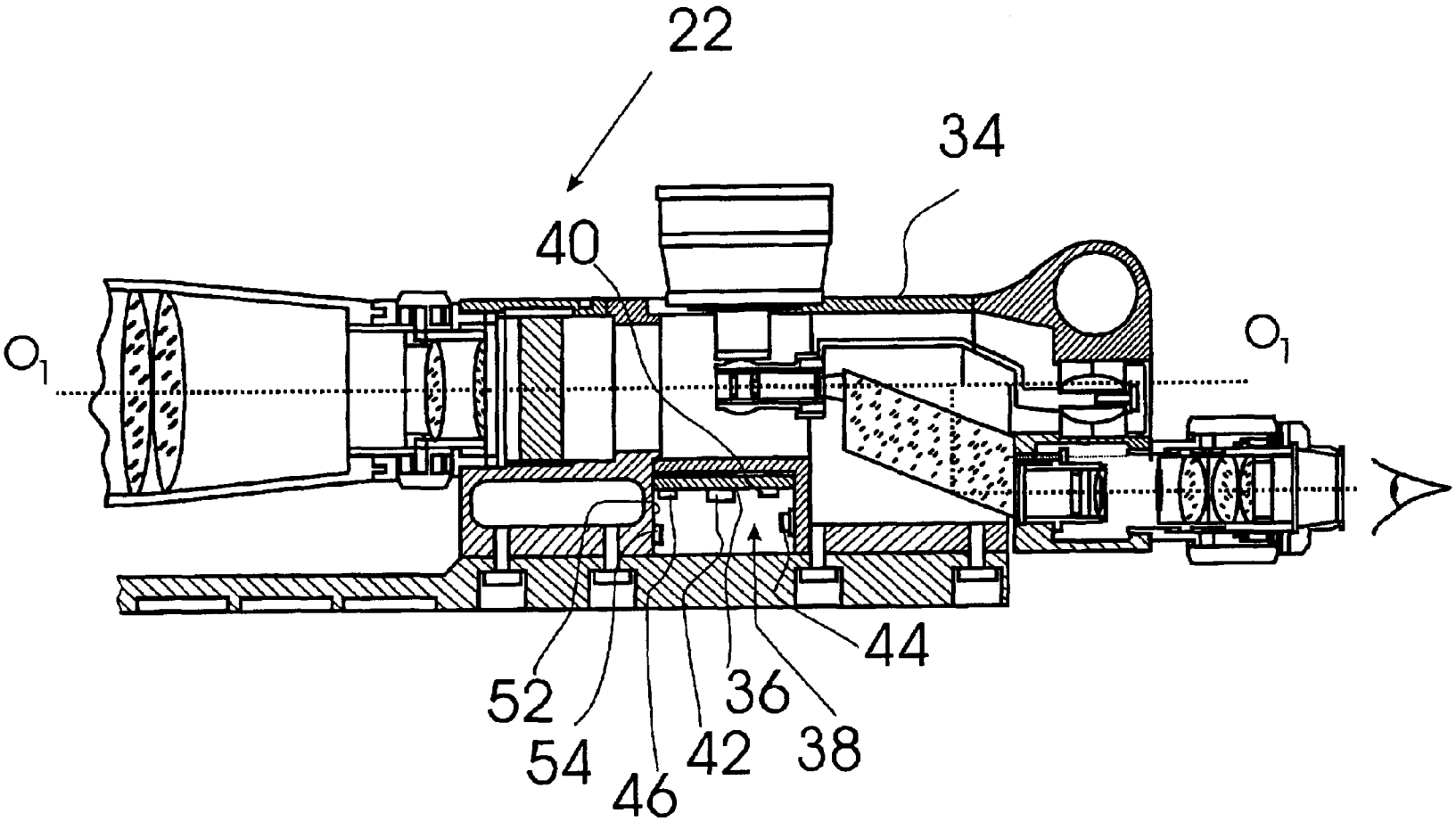
FIG. 2 is a longitudinal sectional view of the night-vision sight of the invention.

A more detailed longitudinal sectional view of the aforementioned night-vision sight of the invention is shown in FIG. 2. It can be seen that a standard night-vision sight 22, e.g., the one mentioned above, has plenty of room inside the night-vision sight housing 34 for placing measuring units of the invention in one of the inner housing compartments. In the embodiment shown in FIG. 2, the measuring units, which are shown as-a printed circuit board (PCB) 36, are secured to the housing 34 in a compartment 38. Reference numeral 40 designates a clock generator, which generates time clocks counted by a clock counter 42. Reference numeral 44 designates a signal transmitter, e.g., an infrared signal transmitter located on the outer side of the night-vision device 22 or inside the housing 34 but exposed to the outside, e.g., through an opening (not shown).

Figure 3:
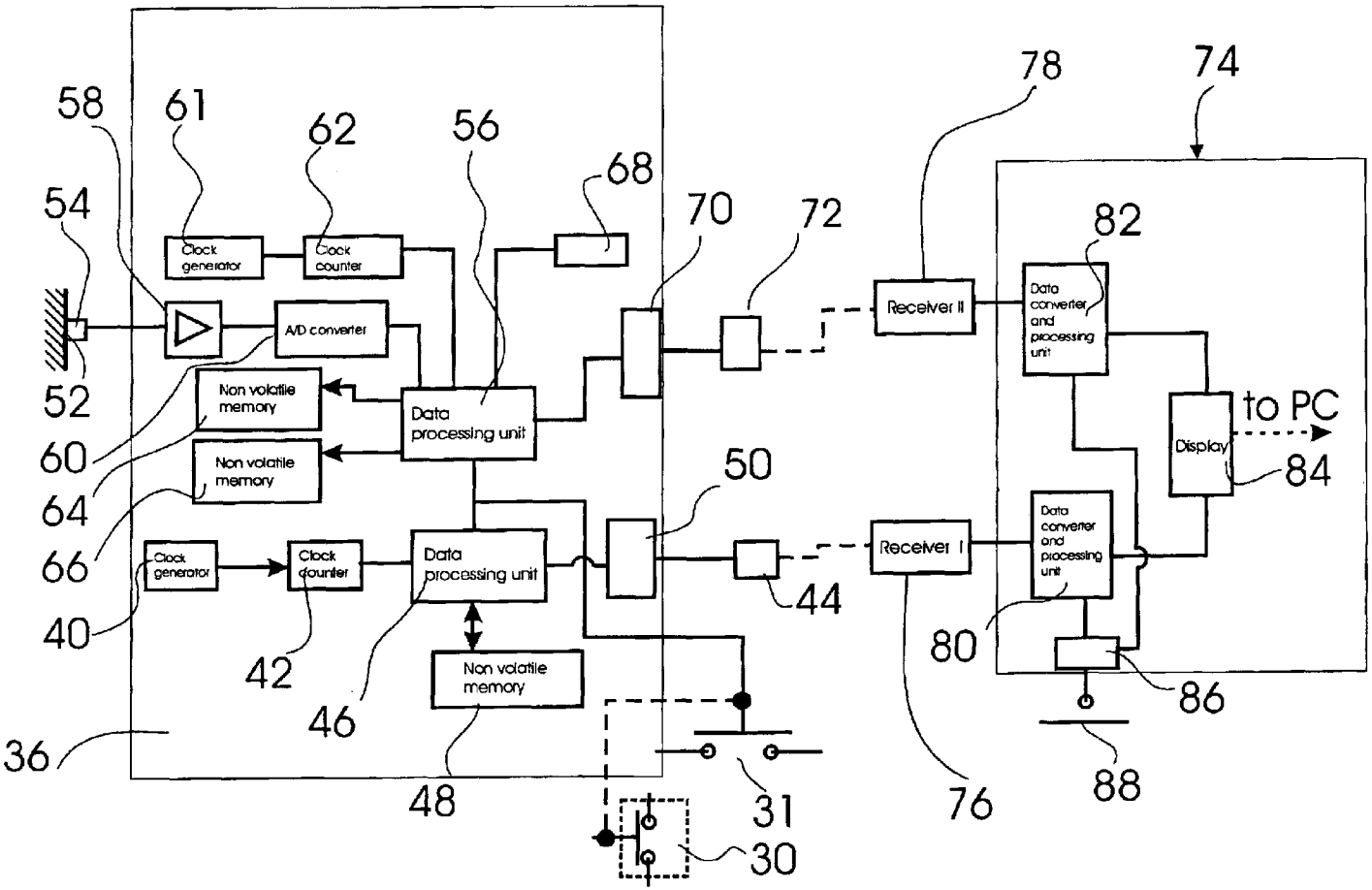
FIG. 3 is a block diagram of an electric circuit of the measuring and counting system used in the night-vision system of the invention.

A block diagram of an electric circuit of the measuring and counting system used in the night-vision system of the invention is shown in FIG. 3. As can be seen from FIG. 3, the clock generator 40 installed on the PCB 36 is connected to a data processing unit 46 via a clock counter 42 which counts the accumulated number of time clock signals generated by the clock generator 40. The activation of the clock generator 40, the clock counter, and the data processing unit 46 is interlocked with the ON/OFF button 30 of the night-vision aiming device 22 (FIG. 1). The data processing unit 46 is permanently connected with a nonvolatile storage memory 48, which receives the information from the output of the data processing unit 46 and permanently stores the obtained data in the memory ready for retrieval at any time. Another output of the data processing unit 46 is connected to the aforementioned signal transmitter 44, e.g., infrared signal transmitter (FIGS. 1, 2, 3), via a driver 50. The aforementioned elements may be mounted on the aforementioned PCB 36 (FIGS. 2 and 3).

A surface of the scope, preferably the one perpendicular to the optical axis $O_1$—$O_1$ of the night vision riflescope 22, e.g., an inner wall 52 of the compartment 38, supports a shot sensor, e.g., in the form of a piezo-sensor 54. It is understood that the wall 52 is also perpendicular to the direction of shooting. With such an arrangement of the shot sensor 54, the recoil forces generated during shooting will be most efficiently perceived by the sensor 54.

The PCB 36 also supports another data processing unit 56, which is connected to the piezo-sensor 54 via a signal amplifier 58 and an analog/digital converter (AID converter) 60. Reference numeral 61 designates a second clock generator, which is connected to the data processing unit 56 via a clock counter 62. This counter is needed for proper operation of the data processing unit 56.

The data processing unit is connected to two memory units, i.e., a nonvolatile memory unit 64 for registering and storing the total number of shots detected by the piezo-sensor 54 and a nonvolatile memory unit 66 for registering and storing the total number of shots produces during the active work of the night-vision aiming device 22 (FIGS. 1 and 2), which is energized by pushing the push-button 30.

Reference numeral 68 designates a power supply battery that keeps the aforementioned second set of elements, i.e., the signal amplifier 58, the data processing unit 56, the clock generator 60, the clock counter 62, etc., energized and that supplies the power to the first set of the elements, i.e., the clock generator 40, the clock counter 42, the data processing unit 46, etc., when the push button 30 is pressed.

The aforementioned second set of elements contains a driver 70 and may contain a second signal transmitter 72, e.g., infrared signal transmitter located on the outer side of the night-vision device 22 or inside the housing 34 but exposed to the outside, e.g., through an opening (not shown). Reference numeral 31 (FIG. 3) designates a push button, which activates retrieval of the information stored in the memory units 42, 64, and 66.

Those skilled in the art understand that both aforementioned sets of elements may be powered from a common power source and may share the same data processing unit.

A unit 74 shown on the right side of FIG. 3 designates a remotely-located signal receiving and displaying unit, which contains a first receiver 76 for receiving signals from the signal transmitter 44 and a second receiver 78 for receiving signals from the signal transmitter 72. The data received by the receivers 76 and 78 are transmitted to respective data processing units 80 and 82 and displayed on a display 84. Reference numeral 86 designates a power source for supplying power to the receivers 46, 78, the data processing units 80, 82, and the display 84 after pressing on the push button 88. The measured values are compared with given values or with a single reference given value that limits the life expectancy of the device for determining the remaining life-expectancy resource.

The transmitter-receiving system composed of the transmitters 72, 44 and receivers 78, 76 with the auxiliary devices may be implemented in different forms and may comprise standard systems, which are beyond the scope of the present invention. For example, this may be a system similar to the one used in a conventional TV remote control.

Figure 4:
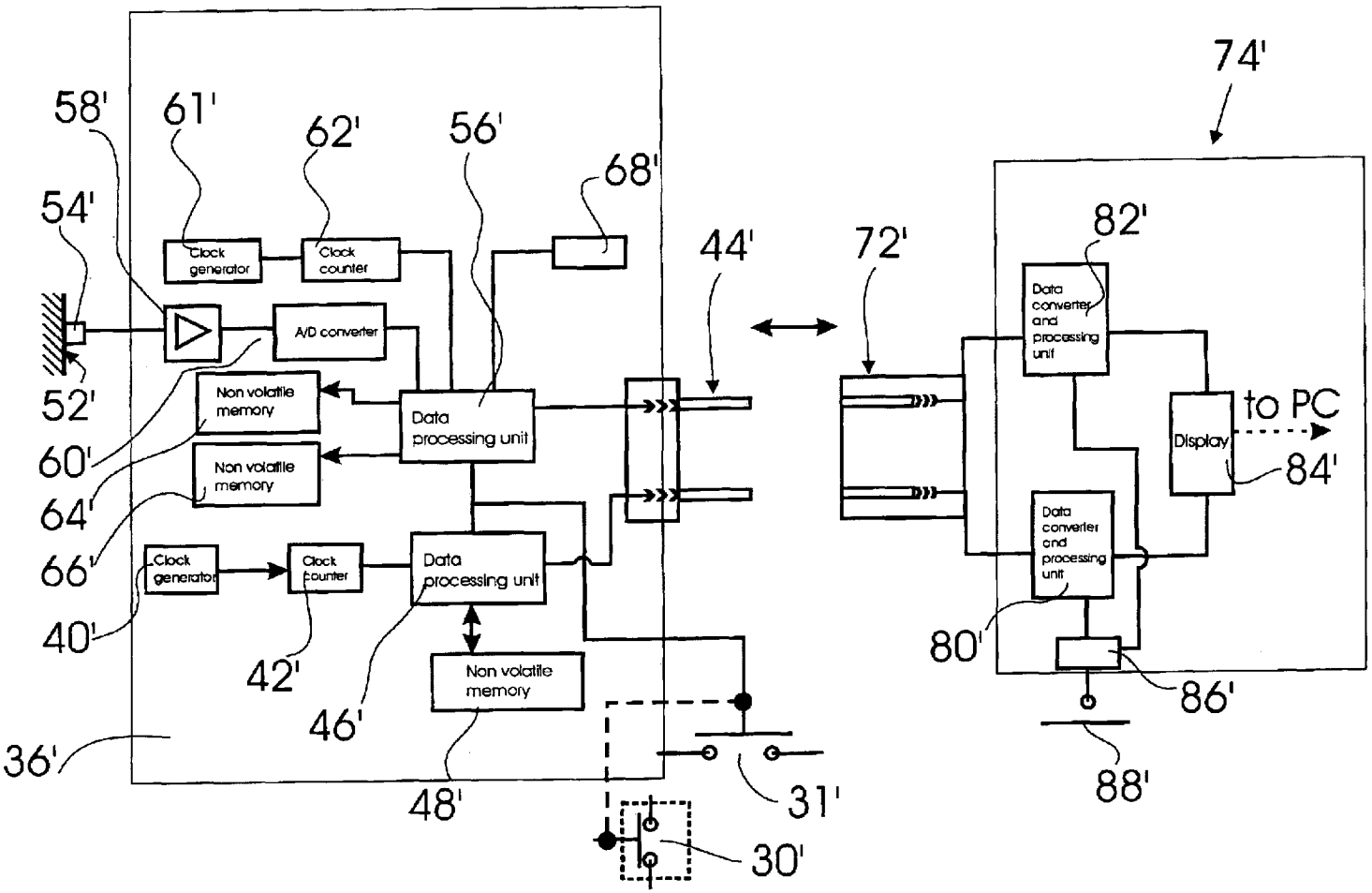
FIG. 4 is a block diagram similar to the one shown in FIG. 3 for an embodiment in which reading of data from the respective data processing units is carried not via a remote control system but via direct electric connection of the data processing units to a data-reading unit via a connector.

FIG. 4 is a block diagram similar to the one shown in FIG. 3 for an embodiment in which reading of data from the respective data processing units is carried out not via a remote control system but via direct electric connection of the data processing units 56' and 46' to a data reading unit 74' via a connector, e.g., a pin connector 44'–72'. The rest of the diagram is identical to the diagram of FIG. 3. The parts of the circuit of FIG. 4 equivalent to those of FIG. 3 are designated by the same reference numerals with an addition of a prime, e.g., the piezo-sensor 54 of FIG. 3 will correspond to a piezo-sensor 54' of FIG. 4, etc. Therefore the description of the remaining elements of the diagram of FIG. 4 is omitted. It is understood that the display 84' may be installed on the riflescope 20.

The night-vision riflescope 20 of the aforementioned embodiment operates as follows.

The power supply battery 68 always keeps the second set of elements, i.e., the signal amplifier 58, the data processing unit 56, the clock generator 60, the clock counter 62, etc., energized, so that whenever a shot is produced from the rifle 20, the recoil of the firearm 20 resulting from the shot will be registered by the piezo-sensor 54, and the accumulated number of the shots produced from the firearm 20 will be counted by the central processing unit 56 and stored in the nonvolatile memory unit 66 for retrieval on demand.

When the pushbutton 30 is pushed on, the power supply battery 68 energizes the first set of the elements, i.e., the clock generator 40, the clock counter 42, the data processing unit 46, etc. As a result, a night-vision riflescope is activated, and the time of its active work, i.e., the time during which it is switched on, is measured and added to the previously accumulated total time of the active work which is stored in the nonvolatile memory unit 48. At the same time, the data processing unit 46 of the first set of the elements sends a command to the data processing unit 56 of the second set of the elements for separately counting and storing in the nonvolatile memory unit 64 the number of shots produced from the firearm irrespective of the operation of the night vision system and in the nonvolatile memory unit 66 the number of shots produced during the working time of the night vision system (i.e., with muzzle flashes that can affect the light-sensitive elements of the night vision system).

When it is necessary to display the information about the total number of shots, the accumulated time of active work of the night vision system, and about the number of shots produced during operation of the night-vision with the damaging effect of the muzzle flashes, first the push button 88 of the data receiving unit 74 is pushed on for activating the elements of this unit. Then data processing units 56 and 46 are activated by pushing on the button 31 (FIG. 3) for retrieving the aforementioned information from the respective memory units 64, 66 and 48 and for transmitting the retrieved data via the transmitters 72 and 44 to the receivers 78 and 76 remotely (FIG. 3) or directly from the data processing units 56' and 46' via the connector 44' to the receiving unit 74' (FIG. 4).

Thus it has been shown that the present invention provides a night-vision optical device having a controlled life expectancy, which accumulates information about the time of active work of the device, the total number of shots produced from the firearm, and the number of shots produced only during active work of the night vision system with muzzle flashes that affect the life time of such elements as cathodes, phosphorescence screens, and luminescent devices which degrade under the effect of light.

The invention has been shown and described with reference to specific embodiments, which should be construed only as examples and do not limit the scope of practical applications of the invention. Therefore any changes and modifications in technological processes, constructions, materials, shapes, and their components are possible, provided these changes do not depart from the scope of the attached patent claims. For example, in addition to a riflescope, the night vision optical device may comprise night vision binoculars, monoculars, goggles, etc. The diagrams of FIGS. 3 and 4 can be accomplished with different arrangements and types of their components. For example, a single CPU may control operation of the elements of both sets, and the receiver-transmitter system may comprise a standard commercially produced transceiver. The night vision optical device may contain a selector connected to an alarm unit, which will produce a warning signal when the selected values of one, two, or all three aforementioned parameters or a certain parameter that expresses relationship between them is reached.

What is claimed is:

1. A night-vision optical device having controlled life expectancy comprising:

switching means for switching on or switching off said night-vision optical device;

time measuring means installed on a firearm for use as a night vision optical sight for measuring the total accumulated time during which said night-vision optical device was switched on by said switching means; and means for counting the number of shots produced from said firearm when said night vision optical sight is activated by said switching means.

2. The night-vision optical device of claim 1, wherein said means for counting number of shots counts the total number of shots produced from said firearm irrespective of whether said night-vision optical device is activated or not.

3. The night-vision optical device of claim 2, wherein night vision optical sight has a housing with a compartment inside said housing, said means for counting the number of shots produced from said firearm when said night vision optical sight is activated by said switching means, and said means for counting the total number of shots are installed in said compartment.

4. The night-vision optical device of claim 2, wherein said means for counting the total number of shots is a piezo-sensor attached to said night vision optical sight.

5. The night-vision optical device of claim 2, wherein said firearm has a direction of shooting, said compartment has a wall substantially perpendicular to said direction of shooting, said means for counting the total number of shots is a piezo-sensor attached to said wall.

6. The night-vision optical device of claim 2, further comprising a first nonvolatile memory units for storing information about said total accumulated time during which said night-vision optical device was switched on by said switching means, a second nonvolatile memory unit for storing information about said number of shots produced from said firearm when said night vision optical sight is activated by said switching means, and a third nonvolatile memory unit for storing information about said total number of shots.

7. The night-vision optical device of claim 5, further comprising a first nonvolatile memory units for storing information about said total accumulated time during which said night-vision optical device was switched on by said switching means, a second nonvolatile memory unit for storing information about said number of shots produced from said firearm when said night vision optical sight is activated by said switching means, and a third nonvolatile memory unit for storing information about said total number of shots.

8. The night-vision optical device of claim 6, further comprising a data reading unit for selectively retrieving said information at least from one of said first nonvolatile memory unit, said second nonvolatile memory unit, and said third nonvolatile memory unit, said data reading unit having a display.

9. The night-vision optical device of claim 8, wherein said data reading unit is connected to said first nonvolatile memory unit, said second nonvolatile memory unit, and said third nonvolatile memory unit via a remote control data transmission system.

10. The night-vision optical device of claim 7, further comprising a data reading unit for selectively retrieving said information at least from one of said first nonvolatile memory unit, said second nonvolatile memory unit, and said third nonvolatile memory unit, said data reading unit having a display.

11. The night-vision optical device of claim 10, wherein said data reading unit is connected to said first nonvolatile memory unit, said second nonvolatile memory unit, and said third nonvolatile memory unit via a remote control data transmission system.

12. The night-vision optical device of claim 8, wherein said data reading unit is connected to said first nonvolatile memory unit, said second nonvolatile memory unit, and said third nonvolatile memory unit via a disconnectable connector.

13. The night-vision optical device of 10, wherein said data reading unit is connected to said first nonvolatile memory unit, said second nonvolatile memory unit, and said third nonvolatile memory unit via a disconnectable connector.

14. A method for controlling a life expectancy of a night vision optical device comprising the steps of:

providing said night vision optical device with means for switching on or switching off said night-vision optical device and with time measuring means;

measuring the total accumulated time during which said night-vision optical device was switched on by said switching means; and controlling the life expectancy of said night vision optical device by comparing said total accumulated time with a given value.

15. The method of claim 14, further comprising the steps installing said night vision optical device on a firearm for use as a night vision optical sight.

16. The method of claim 15, further comprising the step of counting the number of shots produced from said firearm when said night vision optical sight is activated by said switching means.

17. The method of claim 15, further comprising the step of counting the total number of shots produced from said firearm irrespective of whether said night-vision optical device is activated or not.

18. The method of claim 16, further comprising the step of counting the total number of shots produced from said firearm irrespective of whether said night-vision optical device is activated or not.

19. The method of claim 18, comprising the step of activating said means for measuring the total accumulated time simultaneously with switching on said night vision optical sight.

20. The method of claim 19, comprising the step of memorizing total accumulated time, said total number of shots produced from said firearm irrespective of whether said night-vision optical device is activated or not, and said number of shots produced from said firearm when said night vision optical sight Is activated by said switching means in separate nonvolatile memory units for storage as memorized values, retrieving at least one of said memorized values, and determining the remaining resource of said life expectancy with at least one given value.

* * * * *